United States Patent [19]

Medina et al.

[11] 4,227,638

[45] Oct. 14, 1980

[54] RETRACTABLE CLINCHING ANVIL STAPLER

[75] Inventors: Conrad R. Medina, Skokie; Wifredo L. Ramiro, Homewood, both of Ill.

[73] Assignee: Spotnails, Inc., Rolling Meadows, Ill.

[21] Appl. No.: 2,363

[22] Filed: Jan. 10, 1979

[51] Int. Cl.[2] ..... B25C 7/00

[52] U.S. Cl. ..... 227/155

[58] Field of Search ..... 227/130, 155, 156

[56] References Cited

U.S. PATENT DOCUMENTS 2,824,307 2/1958 Marano ..... 227/156

FOREIGN PATENT DOCUMENTS 641992 2/1937 Fed. Rep. of Germany ..... 227/155

1908368 2/1971 Fed. Rep. of Germany ..... 227/155

*Primary Examiner*—Paul A. Bell

*Attorney, Agent, or Firm*—Pennie & Edmonds

[57] ABSTRACT

A stapler is disclosed having an anvil moveable from a clinching to a non-clinching position. In either selected position cooperating stops are provided to retain the anvil in position. To move from one position to the other a pivot arrangement is provided for the anvil support arm to pivot the same to the frame of the stapler. To engage and disengage the stops the anvil support arm is moved axially of the pivot.

6 Claims, 11 Drawing Figures

FIG.1
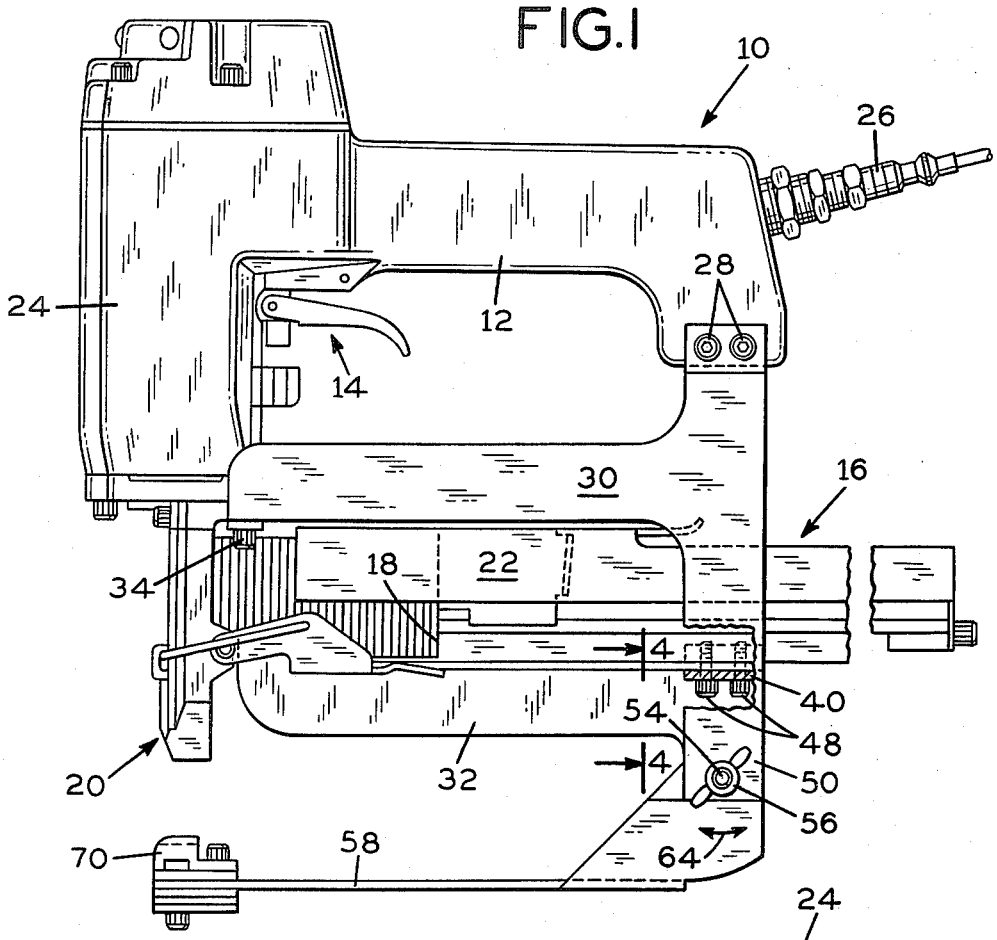
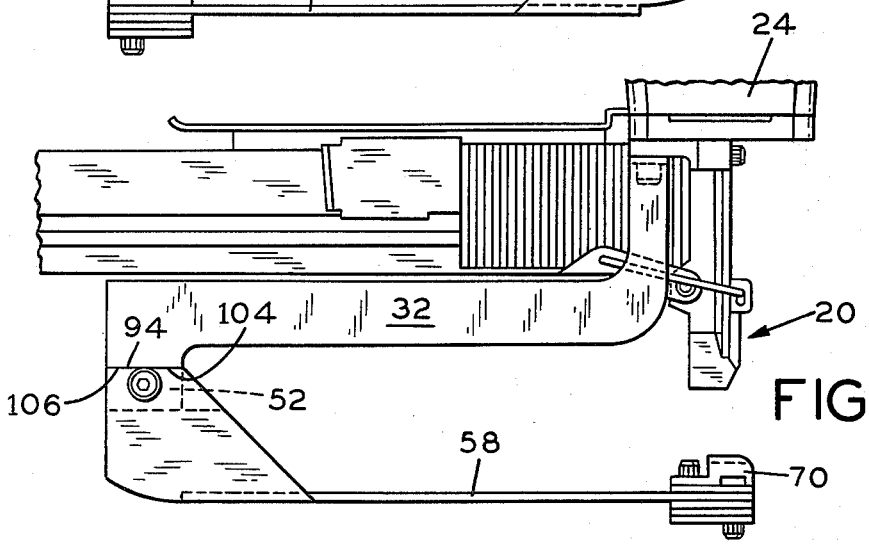
FIG.2

RETRACTABLE CLINCHING ANVIL STAPLER

BACKGROUND OF THE INVENTION

The invention relates to a stapler, more particularly a power operated stapler which includes a clinching anvil that may be positioned beneath the nose piece of the stapler in order to clinch the staplers driven through material and which anvil may be moved out of alignment with the nose piece of the stapler so that staples may be driven into material without being clinched. Such staplers provide the facility of attaching separate pieces to each other such as the flaps on a cardboard carton in which the staples are clinched after being driven through the flaps. At the same time, however, when the anvil is moved out of a clinched position the staples may be driven to hold two elements together such as the flap of a carton and the wood of a wooden pallet in which the staples terminate in the wood and are not clinched.

THE PRIOR ART

Staplers having anvils mounted to be moved from a clinching position in alignment with the nose piece to a non-clinching position removed from the nose piece are known. Generally the anvil is mounted on the base of the stapler and the main frame of the stapler is pivotally mounted to the base in such a fashion that the base and the frame of the stapler may be pivoted relative to each other to bring the anvil into alignment with the noise piece for clinching or to move the anvil well out of alignment with the nose piece when it is desired to drive the staple without clinching. Frequently a latch mechanism is provided for retaining the frame of the stapler and the base in either one or both of the selected positions. Such a stapler is shown in U.S. Pat. No. 2,824,307.

Other variations are known as illustrated in U.S. Pat. Nos. 1,855,178; 2,059,021; 2,218,794; 2,378,725; 2,687,522 and 4,051,991.

Frequently these staplers are held in either or both of the selected positions by a frictional arrangement or by some sort of latch. Often, the latch has its operating element underneath the base in an inconvenient location. Further, such known devices are not generally suitable for the heavy duty power staplers which incorporate an anvil and an anvil support arm of significant weight

BRIEF SUMMARY OF THE INVENTION

In the present invention an anvil is mounted upon an anvil support arm in turn pivoted to the frame of the stapler is provided in which the anvil support arm may be rotated about the axis of the pivot to either of two positions arranged at substantially 180° with respect to each other. In the first position the anvil is aligned with the nose piece of the stapler for clinching staples and in the second position the anvil is arranged at 180° removed therefrom to permit the driving of staples without clinching. First and second positioning stops on the frame and first and second cooperating stops on the anvil support arm cooperate respectively to maintain the anvil support arm in either of its two selected positions by virtue of the weight of the arm which tends to pivot the same about the pivot.

In order to move the arm from the first to the second position the arm and the frame are moved laterally with respect to each other, i.e., along the axis of the pivot. A spring is positioned between the pivot support arm and the frame for urging the same relative to each other along the axis of the pivot in order to maintain alignment between the selected positioning stops and cooperating stops. The force of the spring may be overcome manually in order to effect relative movement between the frame and pivot support arm along the axis of the pivot in order to permit disengagement between the selected positioning stops and the cooperating stops and upon subsequent rotation about the pivot to the other selected position the spring will effect relative movement of the frame and arm axially of the pivot to again insure engagement of the stops in the new position.

BRIEF DESCRIPTION OF THE DRAWINGS

The construction and operation of the device will be apparent to those skilled in the art from the following description and drawings in which:

FIG. 1 is a side elevation of a power stapler having the anvil support arm of this invention;

FIG. 2 is a slightly enlarged view of the lower portion of the device of FIG. 1 taken from the opposite side of the device;

DETAILED DESCRIPTION OF THE PREFERRED EMBODIMENT

Figures 3, 4, 5:
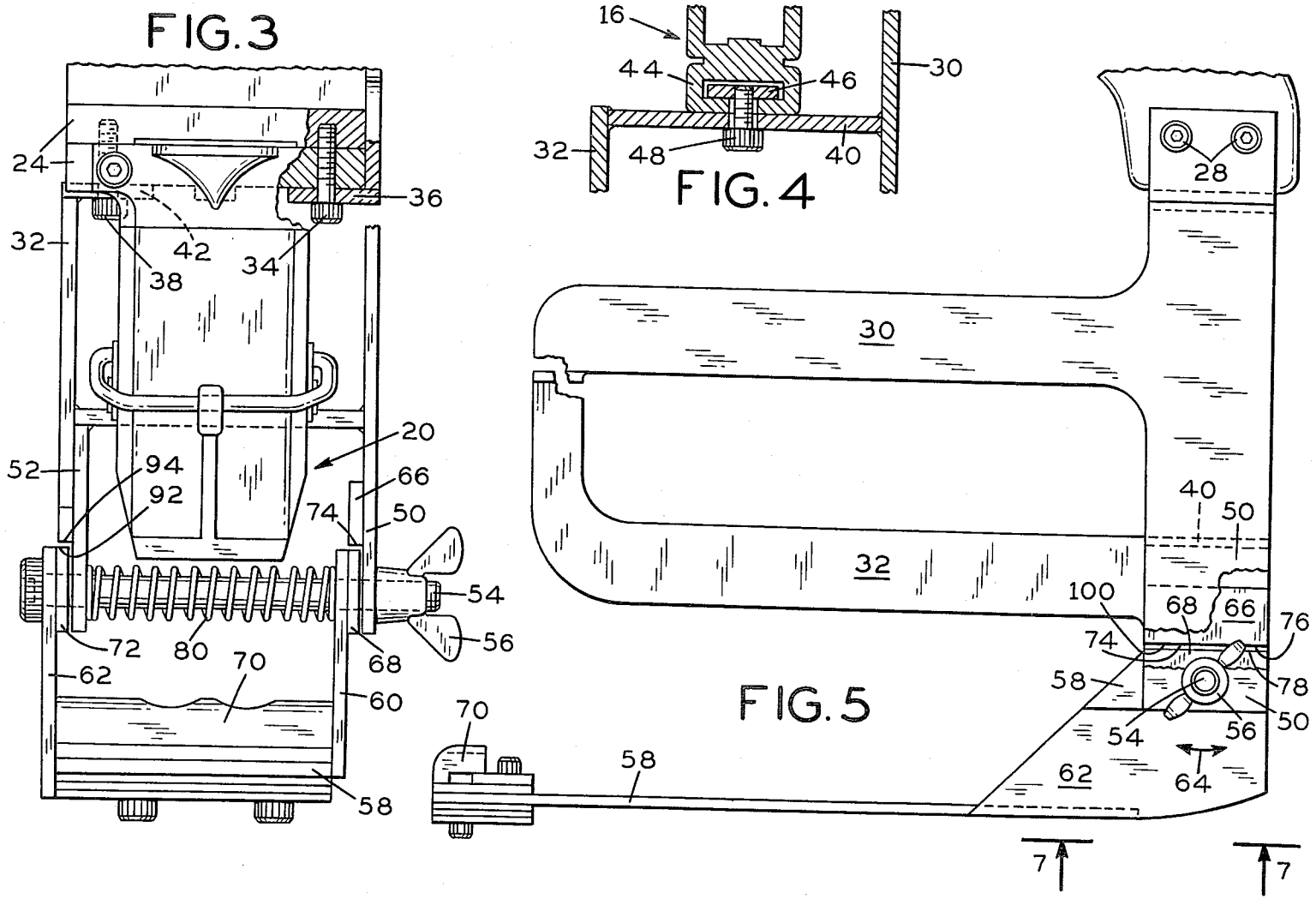
FIG. 3 is an enlarged frontal elevation of the lower portion of the stapler of FIG. 1.
FIG. 4 is an enlarged view taken along the line 4—4 of FIG. 1.
FIG. 5 is a view similar to FIG. 1 showing the anvil in a clinching position as in FIGS. 1 and 2 but considerably enlarged and with portions of the stapler removed for clarity.

Shown in FIG. 1 is a power operated stapler 10 having a handle grip 12, a trigger mechanism, generally indicated at 14, a staple magazine generally indicated at 16 having a plurality of staples 18 which are fed by a spring operated follower 22 into the nose piece 20 of the stapler 10. The staples are driven by a driving blade (not shown) through a pneumatically power operated cylinder-piston arrangement (not shown) positioned within the housing 24 which housing 24 is integral with the handle 12. Pneumatic pressure is provided to the interior of the handle 12 and to mechanism within the housing 24 by a suitable inlet fitting 26 from a source of compressed air (not shown). The construction and operation of the heavy duty pneumatically operated stapler 10 is known and, accordingly, is not detailed here.

In the present invention the frame of the stapler 10 includes the handle 12, the integral housing 24, and a sub-frame 30, 32 mounted on opposite sides of the stapler 10. As shown, the sub-frame member 30 is secured by screws 28 to the handle 12 at the rearward end of the sub-frame member 30 and at its forward end by means of a screw 34 passing through a flange 36 on the sub-frame member 30 and into the housing 24 of the stapler 10. The sub-frame member 32 is also secured at its forward end by a screw 38 extending into the housing 24 through an opening in a flange 42 on the sub-frame member 32.

At the rearward end of the sub-frame members 30 and 32 are joined by a cross bar 40 which may be welded to the same as best shown in FIG. 4. The magazine 16 has a downwardly opening generally U-shaped channel 44 in which a small plate 46 may be fitted. A pair of screws 48 extend through openings in the cross bar 40 and are threadily engaged in the plate 46 in order to secure the cross bar 40 to the U-shaped channel 44 of the magazine.

Each of the sub-frame members 30 and 32 has a depending ear 50 and 52 respectively (see FIG. 3). Passing through suitable openings in the ears 50 and 52 is a threaded pivot bolt 54 having a wing nut 56 secured to one end thereof. The bolt 54 also passes through suitable openings in the upstanding ears 60, 62 on an anvil support arm 58. The pivot bolt 54 is not threaded in the openings in the ears 50, 52, 60, 62 but is loosely fitted therein. A spring 80 extends between the depending ear 52 on the frame and the upstanding ear 60 on the anvil support arm 58. The spring 80 is under compression and tends to move the anvil support arm 58 and the frame (comprised of the handle 12, housing 24, and sub-frame members 30, 32) in opposite directions along the axis of the pivot bolt 54. As shown in FIG. 3 the frame including depending ear 52 is urged towards the left and the anvil support arm 58 including upstanding ear 60 is urged toward the right.

Figure 6:
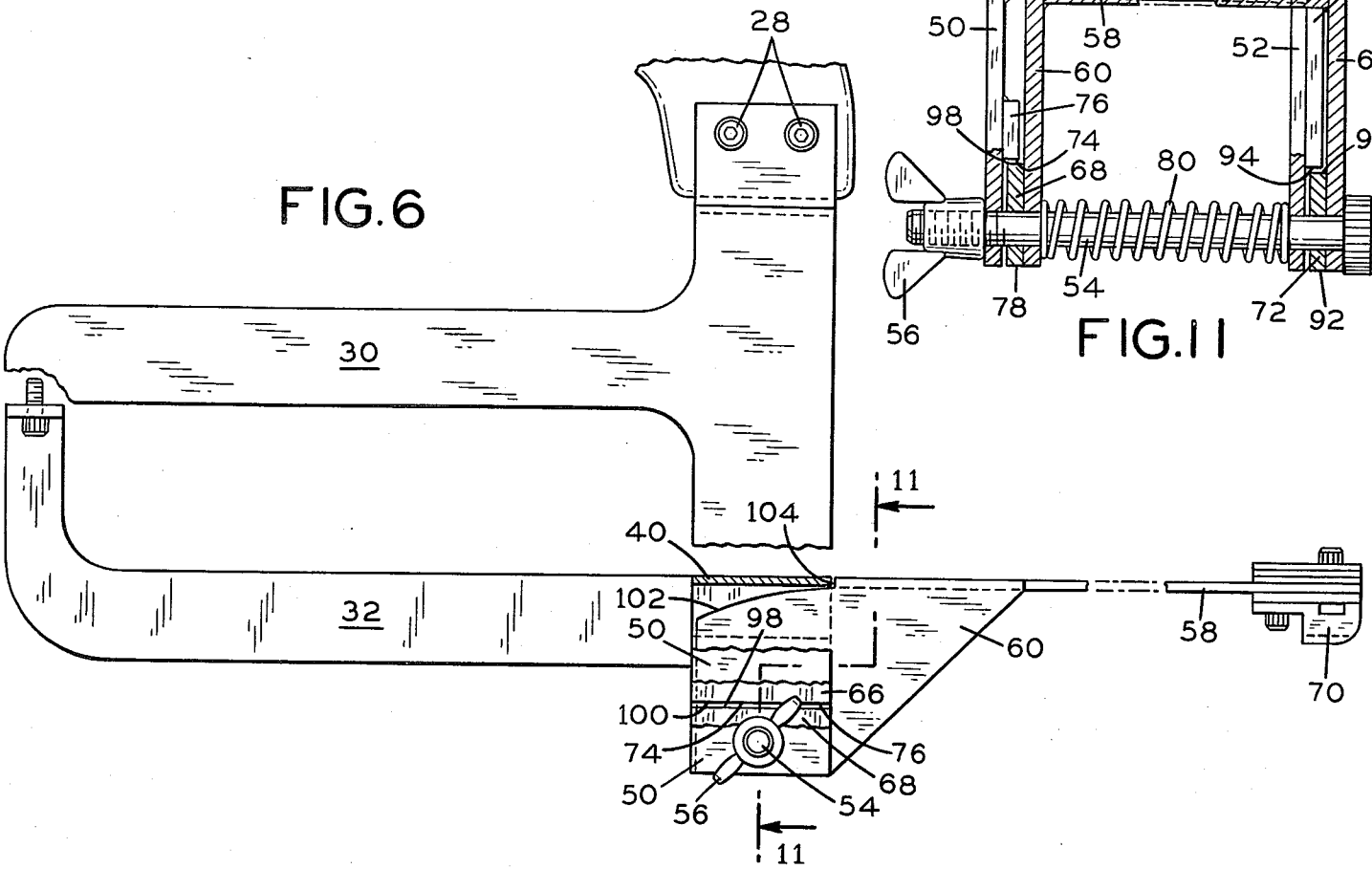
FIG. 6 is a view like FIG. 5 with the anvil moved out of clinching position.

By virtue of the loose fit of the ears 60, 62 on the pivot bolt 54, the anvil support arm 58 may be swung in an arc around the axis of the pivot bolt 54 as indicated by the arrow 64 in FIG. 5. The anvil support arm 58, however, is maintained in either the position of FIG. 5 or the position of FIG. 6 by means of a suitable stop as hereinafter disclosed. The anvil support arm 58 carries a suitable anvil 70 which is in the position of FIG. 5 and is positioned beneath the nose piece 20 to clinch staples driven by the stapler 10 through the material positioned between the nose piece 20 and the anvil 70. As shown in FIG. 6 the anvil 70 on the support arm 58 has been swung rearwardly to its second position 180° removed from its first position. In the position of the anvil 70 as shown in FIG. 6 the stapler 10 may be used to drive unclinched staples into the work piece.

Having reference to FIG. 3, the depending ear 50 has welded thereto on the lower side a stop bar 66. The upstanding ear 60 on the anvil support arm 58 has welded thereto cooperating stop bar 68. Also, the upstanding ear 62 has welded thereto a stop bar 72 for cooperation with stop surfaces on the lower edge of the sub-frame 32 as hereinafter disclosed.

As shown in FIG. 5 the lower end of the ear 50 on the sub-frame 30 has been broken away to show the otherwise hidden stop bar 66. The break also permits viewing the otherwise hidden upper portion of the stop bar 68 secured to the upstanding ear 60 (see FIG. 3). The stop bar 66 has a lower edge 74 which in the area adjacent its rearward end at 76 comprises a stop surface which cooperates with a stop surface 78 on the upper edge of the stop bar 68 to prevent rotation of the anvil support arm 58 about the pivot bolt 54. In FIG. 5 the lower surface of the stop bar 66 and the upper surface of the stop bar 68 are shown spaced apart for clarity but it will be appreciated that in the position shown the same are in contact along substantially their full length and in particular along the rearward portion 76 of such surfaces. The same is true for the showing of these parts in FIG. 3, 7 and 8 in which the anvil support bar is positioned with the anvil beneath the nose piece for clinching staples and in which the stops are shown.

Figure 11:
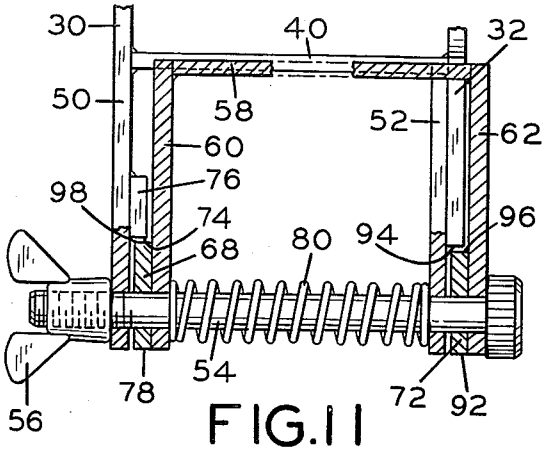
FIG. 11 is a view taken along the line 11—11 of FIG. 6.
Figure 9:
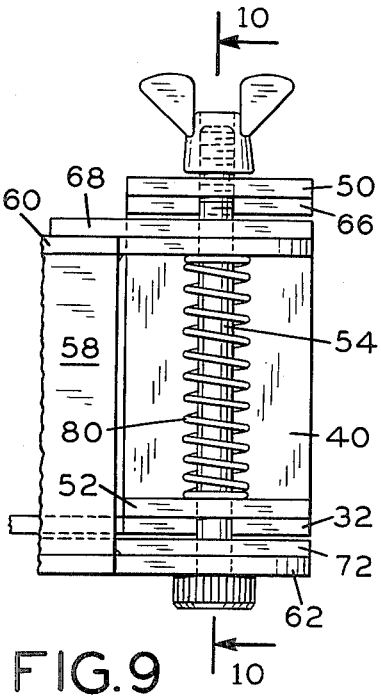
FIG. 9 is a view similar to FIG. 7 in which the anvil support arm has been moved along the axis of the pivot relative to the stapler frame to disengage the same from its first position.
Figure 10:
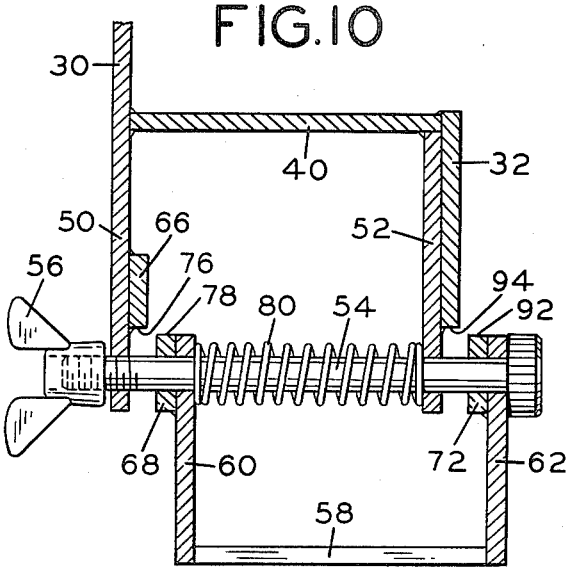
FIG. 10 is taken along the line 10—10 of FIG. 10.

On the opposite side the stop bar 72 has an upper surface 92 cooperating with the lower surface 94 on the lower edge of the sub-frame member 32 thus providing a second stop mechanism on the opposite side for maintaining the anvil 70 and its support arm 58 in the position of FIG. 5. When it is desired to move the anvil 70 out of alignment with the nose piece 20 the operator loosens wing nut 56 sufficiently to permit the ears 60, 62 and support arm 58 to be moved to the left as viewed in FIG. 3 to desengage the stop bars 60, 68 and also the stop bar 72 from the lower edge 94 of the member 32. When this has been accomplished the parts will be in the position as shown in FIGS. 9 and 10. It will be appreciated that the ears 60, 62 and support arm 58 as shown in FIGS. 9 and 10 are displaced to the right in FIGS. 9 and 10 because the device is being viewed in a direction opposite to that of FIG. 3. Once the parts have assumed the position shown in FIG. 10 then the anvil support arm 58 and its upstanding ears 60, 62 may be swung about the pivot bolt 54 to the position shown in FIG. 6. This swinging motion is counter clockwise as viewed in FIG. 5. As viewed in FIG. 10 the support arm 58 will move downwardly and toward the viewer in the figure and then upwardly. When the movement has covered an arc of about 180° the spring 80 will again be able to urge the anvil support arm 58 to the left as viewed in FIG. 10 and into the position as shown in FIG. 11. The wing nut 56 may then again be tightened.

Figure 7:
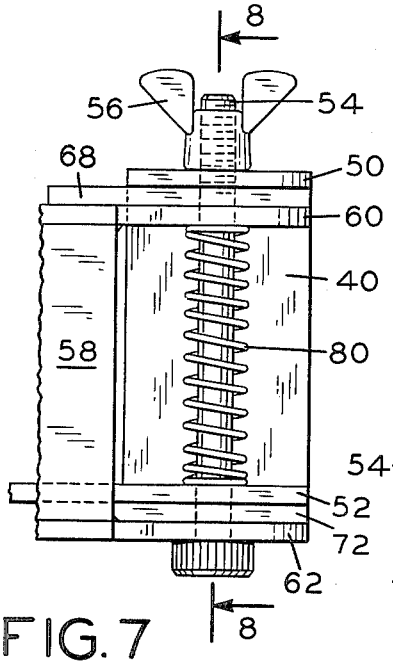
FIG. 7 is an enlarged view taken along the line 7—7 of FIG. 5.
Figure 8:
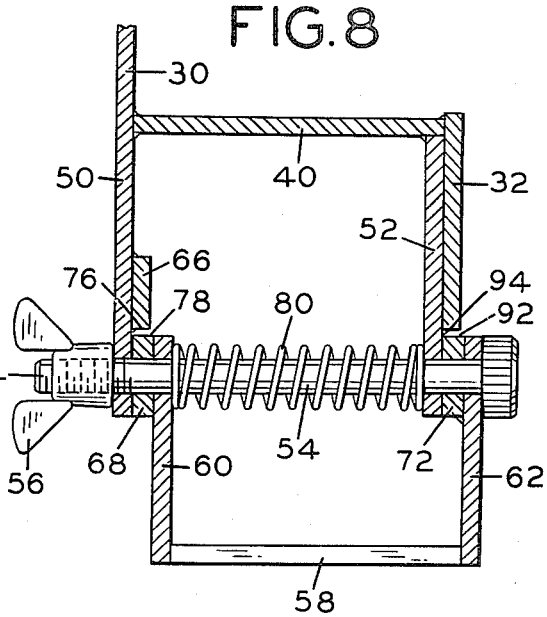
FIG. 8 is taken along the lines 8—8 of FIG. 7.

As shown in FIG. 11 the anvil 70 has now been moved to a position 180° from its first position and extends rearwardly with the anvil support arm 58 now generally in the plain of the cross bar 40. One corner of the ears 60 and 62 as shown at 102 is curved or relieved to permit it to swing past the cross bar 40. An exposed edge 104 on the anvil arm 50 can then abut the cross bar 40 limiting the rotation of the anvil support arm 58 in the counter clockwise direction as viewed in FIG. 6 about the pivot bolt 54. In the position of the anvil support arm 58 as shown in FIGS. 6 and 11, the stop bars 68 and 72 are now inverted and the cooperating stop surfaces 78 and 92 thereon are disposed 180° from the stop surfaces 74 and 94 respectively with which they cooperated in the first position of the device as shown in FIGS. 5, 7 and 8. The stop bar 68 has a surface 98 parallel to and on the opposite side of the pivot bolt 54 with respect to the stop surface 78. Similarly, the stop bar 72 has a stop surface 96 on the opposite side of the pivot bolt 54 from the stop surface 92. The stop surfaces 96 and 98 are now in a position to cooperate respectfully with stop surfaces 74 and 94.

Actually, as shown in FIG. 6, the stop surface 74 comprises two positioning stop surfaces 76 and 100. Stop surface 100 cooperates with the stop surface 98 on stop bar 68 when the anvil support arm 58 is in the position shown in FIG. 6. On the other hand position stop surface 76, as previously described with reference to FIG. 6, cooperates with stop surface 78 when the anvil support arm 58 is in the position in FIG. 5. As shown, positioning stop surface 76 and 100 comprises different portions of a single continual surface 76; however, it will be appreciated that these could be two separate stop elements if desired. By virtue of some place in the device and the tendency of gravity to swing the anvil arm 58 clock wise as viewed in FIG. 6, the positioning stop surface 74 and cooperating surface 98 are not quite parallel as shown but rather positioning stop surface 100 and stop surface 98 are in contact whereas at the other end there may be a space in the area of positioning stop surface 76 between it and the facing surface of the stop bar 68. Having reference to FIG. 5 the same is true in reverse with respect to stop surface 74 and stop surface 78. Stop surface 78 will be in contact with positioning stop surface 76 while some gap exists between positioning stop surface 100 and the stop bar 68.

On the other side and still having reference to FIG. 11, stop surface 96 has now come into contact with stop surface 94 on the lower end of the sub-frame member 32. The positioning stop surface 94, like positioning stop surface 74, has forward and rearward positioning stop surfaces (see FIG. 2) 104 and 106 respectively cooperating with cooperating stop surfaces 92 and 94 respectively for the clinching position (FIG. 2) and the non-clinching position (FIG. 6) respectively. While the cooperating stop surfaces 104 and 106 are shown as a single continuous surface 94 at the bottom edge of the sub-frame member 32, it will be appreciated that each could be a separate element.

While it is preferred for several reasons to maintain the wing nut 56 reasonably, snugly tight during use in either of the two operating positions, and to loosen the same in order to permit relative movement between the frame and the anvil support arm 58 axivally of the pivot bolt 54 when it is desired to move from one position to the other on the reverse, the spring 80 does permit the wing nut 56 to be left loose at all times since the spring will ensure proper positioning of the stops and cooperating stops within the limits imposed by its resiliency.

We claim:

1. In a stapler having a frame, an anvil for clinching staples, an anvil support arm, and pivot means mounting said support arm on said frame for rotational movement about the axis of said pivot means to and between a first clinching position and a second non-clinching position, the improvement comprising:

(a) first and second positioning stops on said frame, (b) first and second cooperating stops on said arm for cooperation respectively with said first and second positioning stops, (c) said first cooperating stop engaging said first positioning stop in said first position of said anvil to maintain said arm and said anvil in said first clinching position, (d) said second cooperating stop engaging said second positioning stop to maintain said arm and said anvil in said second non-clinching position, and (e) said pivot means mounting said anvil support arm to said frame also providing for relative movement axially of said pivot means of said frame and said anvil support arm to engage and disengage said cooperating stop with said positioning stop thus permitting movement of said arm to and between said first and second positions.

2. The stapler of claim 1 including resilient means disposed between said frame and said support arm for urging said cooperating stops into engagement with said positioning stops axially of said pivot means.

3. The stapler of claim 2 including means for preventing relative movement between said frame and said support arm axially of said pivot means.

4. The stapler of claim 3 in which the weight of said anvil and said anvil support arm tends to rotate said arm about said pivot means and maintain the selected cooperating stop in engagement with the selected positioning stop under the urging of gravity.

5. The stapler of claim 4 in which said frame includes a pair of spaced sub-frame members and a cross member fixed between said spaced sub-frame members, a pair of upstanding ears on said support arm, at least one of said ears having a curved corner to pass by said cross bar during movement of said support arm from said first to said second position.

6. The stapler of claim 5 in which said support arm has a limiting stop which in the second position of said support arm is positioned to engage said cross bar to limit rotation of said arm about said pivot means.

* * * * *

UNITED STATES PATENT AND TRADEMARK OFFICE

CERTIFICATE OF CORRECTION

PATENT NO. :4,227,638

DATED :October 14, 1980

INVENTOR(S) :Conrad R. Medina and Wilfredo L. Ramiro

It is certified that error appears in the above—identified patent and that said Letters Patent is hereby corrected as shown below:

Column 2, Line 57 "to mechanism" should read "to the mechanism"
Column 3, Line 12 "threadily" should read "threadidly"
Column 4, Line 4 "FIG." should read "FIGS."
Column 4, Line 16 "desengage" should read "disengage"
Column 5, Line 33 "axivally" should read "axially"
Column 1, Line 50 "anvil" is mounted" should read "anvil mounted
Column 4, Line 38 "plain" should read "plane"
Column 4, Line 56 "respectfully" should read "respectively"
Column 5, Line 1 "place" should read "space"
Fig. 11 "76" should read "66"
Column 1, Line 8 "staplers" should read "staples"
Column 1, Line 68 "pivot" should read "anvil"
Column 2, Line 6 "pivot" should read "anvil"
Column 4, Line 41 "104" should read "104 prime"
Fig. 6 "104" should read "104 prime"
Column 4, Line 65 "76" should read "74"
Fig. 8 "76" should read "74"
Fig. 10 "76" should read "74"
Column 5, Line 21 "94" should read "96"
Column 4, Line 65 "surface" should read "surfaces"
Column 4, Line 65 "comprises" should read "comprise"

Signed and Sealed this

*Tenth* Day of *March 1981*

[SEAL]

*Attest:*

RENE D. TEGTMEYER

*Attesting Officer* *Acting Commissioner of Patents and Trademark*